US011536288B2

(12) United States Patent
Sawada et al.

(10) Patent No.: US 11,536,288 B2
(45) **Date of Patent: *Dec. 27, 2022**

(54) PROPELLER FAN

(71) Applicant: FUJITSU GENERAL LIMITED, Kanagawa (JP)

(72) Inventors: Hirotaka Sawada, Kanagawa (JP); Kazuya Funada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/980,951

(22) PCT Filed: Feb. 15, 2019

(86) PCT No.: PCT/JP2019/005708
§ 371 (c)(1),
(2) Date: Sep. 15, 2020

(87) PCT Pub. No.: WO2019/181317
PCT Pub. Date: Sep. 26, 2019

(65) Prior Publication Data

US 2021/0010483 A1 Jan. 14, 2021

(30) Foreign Application Priority Data

Mar. 22, 2018 (JP) ..... JP2018-054339

(51) Int. Cl.
*F04D 29/32* (2006.01)
*F04D 25/08* (2006.01)
(Continued)

(52) U.S. Cl.
CPC ..... *F04D 29/32* (2013.01); *F04D 25/08* (2013.01); *F04D 29/322* (2013.01);
(Continued)

(58) Field of Classification Search
CPC ..... F04D 29/32; F04D 29/322; F04D 29/34; F04D 29/384; F04D 29/38; F04D 29/324
See application file for complete search history.

(56) References Cited

U.S. PATENT DOCUMENTS 1,345,055 A * 6/1920 Willour ..... F04D 29/325 416/194
4,130,381 A * 12/1978 Levin ..... F04D 29/36 416/196 R (Continued)

FOREIGN PATENT DOCUMENTS

AU 2005265916 2/2006
AU 2015300206 2/2016

(Continued)

OTHER PUBLICATIONS

International Search Report issued in International Patent Application No. PCT/JP2019/005708, dated May 7, 2019, along with an English translation thereof.

(Continued)

*Primary Examiner* — Igor Kershteyn
*Assistant Examiner* — Brian Christopher Delrue
(74) *Attorney, Agent, or Firm* — Greenblum & Bernstein, P.L.C.

(57) ABSTRACT

A propeller fan includes a hub that has a side surface around a central axis, and blades that are provided on the side surface, wherein a blade of the blades includes an inner peripheral portion located on a side of a base, and an outer peripheral portion located on a side of an outer edge, the outer peripheral portion is formed as one blade, the inner peripheral portion includes blade elements arranged at a predetermined interval, a ratio r/R of a radius r which is a distance from the central axis to the outer peripheral portion and a radius R which is a distance from the central axis to the outer edge is 0.4 or less, and when a wind speed at the (Continued)

outer peripheral portion is V1 and a wind speed at the inner peripheral portion is V2, a relational formula of V1≤V2×2.0 is established.

3 Claims, 10 Drawing Sheets

(51) Int. Cl.
*F04D 29/38* (2006.01)
*F04D 29/34* (2006.01)

(52) U.S. Cl.
CPC ..... *F04D 29/329* (2013.01); *F04D 29/34* (2013.01); *F04D 29/384* (2013.01); *F04D 29/388* (2013.01); *F04D 29/324* (2013.01); *F04D 29/38* (2013.01)

(56) References Cited

U.S. PATENT DOCUMENTS

| | | | | |
|---|---|---|---|---|
| 5,221,187 | A * | 6/1993 | Lorea | F04D 29/386 416/189 |
| 5,330,325 | A * | 7/1994 | Kato | B01F 7/0025 416/227 R |
| 6,736,600 | B1 | 5/2004 | Bannasch | |
| 7,014,425 | B2 * | 3/2006 | Havel | F04D 29/384 416/169 A |
| 8,100,665 | B2 * | 1/2012 | De Filippis | F04D 29/384 416/238 |
| 2004/0062654 | A1 | 4/2004 | Chang et al. | |
| 2004/0208746 | A1 | 10/2004 | Crocker | |
| 2005/0129518 | A1 * | 6/2005 | Havel | F04D 29/326 416/189 |
| 2007/0031250 | A1 | 2/2007 | Suzuki et al. | |
| 2009/0151911 | A1 | 6/2009 | De Filippis et al. | |
| 2010/0266428 | A1 | 10/2010 | Nakagawa et al. | |
| 2011/0200445 | A1 | 8/2011 | Takeda et al. | |
| 2016/0138601 | A1 | 5/2016 | Gallina | |

FOREIGN PATENT DOCUMENTS

| | | | |
|---|---|---|---|
| AU | 2018201617 | | 12/2018 |
| CN | 104047893 | | 9/2014 |
| CN | 104047893 | A | 9/2014 |
| CN | 106460868 | | 2/2017 |
| CN | 108930666 | | 12/2018 |
| EP | 3406912 | | 11/2018 |
| JP | 2003-503643 | A | 1/2003 |
| JP | 2004-116511 | A | 4/2004 |
| JP | 2010-101223 | A | 5/2010 |
| WO | 2011/001890 | | 1/2011 |
| WO | 2011/011890 | A1 | 2/2011 |

OTHER PUBLICATIONS

Written Opinion issued in International Patent Application No. PCT/JP2019/005708, dated May 7, 2019, along with an English translation thereof.
China Office Action issued in CN Application No. 201980018218.0, dated May 28, 2021 with an English machine translation thereof.
Office Action issued in Australian Patent Application No. 2019236795, dated Sep. 3, 2021.
Extended European Search Report for corresponding Application No. 19771495.9, dated Nov. 18, 2021.

* cited by examiner

PROPELLER FAN

FIELD

The present invention relates to a propeller fan.

BACKGROUND

For example, an air conditioner has a propeller fan in its outdoor unit. The wind speed in the propeller fan is high at the outer peripheral portion of the blade and decreases toward the center of rotation. In recent years, in order to improve the energy saving performance of air conditioners, the air flow rate of propeller fans has been improved. Specifically, the "increase in diameter and high speed rotation" of propeller fans have been carried out.

Note that the technology in this field is disclosed in, for example, Japanese Laid-open Patent Publication No. 2010-101223, International Publication No. WO 2011/001890, Japanese Laid-open Patent Publication No. 2003-503643, and Japanese Laid-open Patent Publication No. 2004-116511.

CITATION LIST

Patent Literature

Patent Literature 1: Japanese Laid-open Patent Publication No. 2010-101223

Patent Literature 2: International Publication No. WO 2011/001890

Patent Literature 3: Japanese Laid-open Patent Publication No. 2003-503643

Patent Literature 4: Japanese Laid-open Patent Publication No. 2004-116511

SUMMARY

Technical Problem

In the general technology, the wind speed distribution in the radial direction of the blade becomes non-uniform. Therefore, a surging phenomenon such as sucking air from a downstream side occurs in the inner peripheral portion of the blade, and the operating state becomes abnormal. When a propeller fan is used in an outdoor unit, the surging phenomenon may lead to noise and damage to the propeller fan. Also, the "inner peripheral portion of the propeller fan where the wind speed is slow" does not substantially contribute to the air blowing. For this reason, it can be said that the "air blowing rate obtained for the size of the propeller fan" is small and the blade surface is not effectively used.

One object of the present disclosure is to provide a "propeller fan and an outdoor unit of an air conditioner" capable of "improving the air flow rate of the propeller fan while suppressing a 'difference between the wind speed at the outer peripheral portion and the wind speed at the inner peripheral portion (wind speed difference) of the blade'".

Solution to Problem

According to an aspect of an embodiment, a propeller fan includes a hub that has a side surface around a central axis, and a plurality of blades that are provided on the side surface of the hub, wherein a blade includes an inner peripheral portion that is located on a side of a base connected to the hub of the blade, and an outer peripheral portion that is located on a side of an outer edge of the blade, the outer peripheral portion is formed as one blade surface, the inner peripheral portion includes a plurality of blade elements arranged at a predetermined interval, a ratio r/R in which a radius r which is a distance from the central axis to a boundary between the inner peripheral portion and the outer peripheral portion and a radius R which is a distance from the central axis to the outer edge of the blade is 0.4 or less, and when a wind speed at the outer peripheral portion is V1 and a wind speed at the inner peripheral portion is V2, a relational formula of $V1 \leq V2 \times 2.0$ is established.

Advantageous Effects of Invention

According to one aspect of the present disclosure, it is possible to improve the air flow rate of the propeller fan while suppressing a difference between the wind speed at the outer peripheral portion and the wind speed at the inner peripheral portion (central portion) of the blade.

DESCRIPTION OF EMBODIMENTS

Modes for carrying out the present disclosure will be described in detail below with reference to the drawings. The technology of the present disclosure is not limited by various embodiments described below. Further, the various embodiments described below may be appropriately combined and carried out within a range where they do not contradict. Note that the description of the already-explained elements is omitted.

First Example (Configuration of Outdoor Unit)

Figure 1:
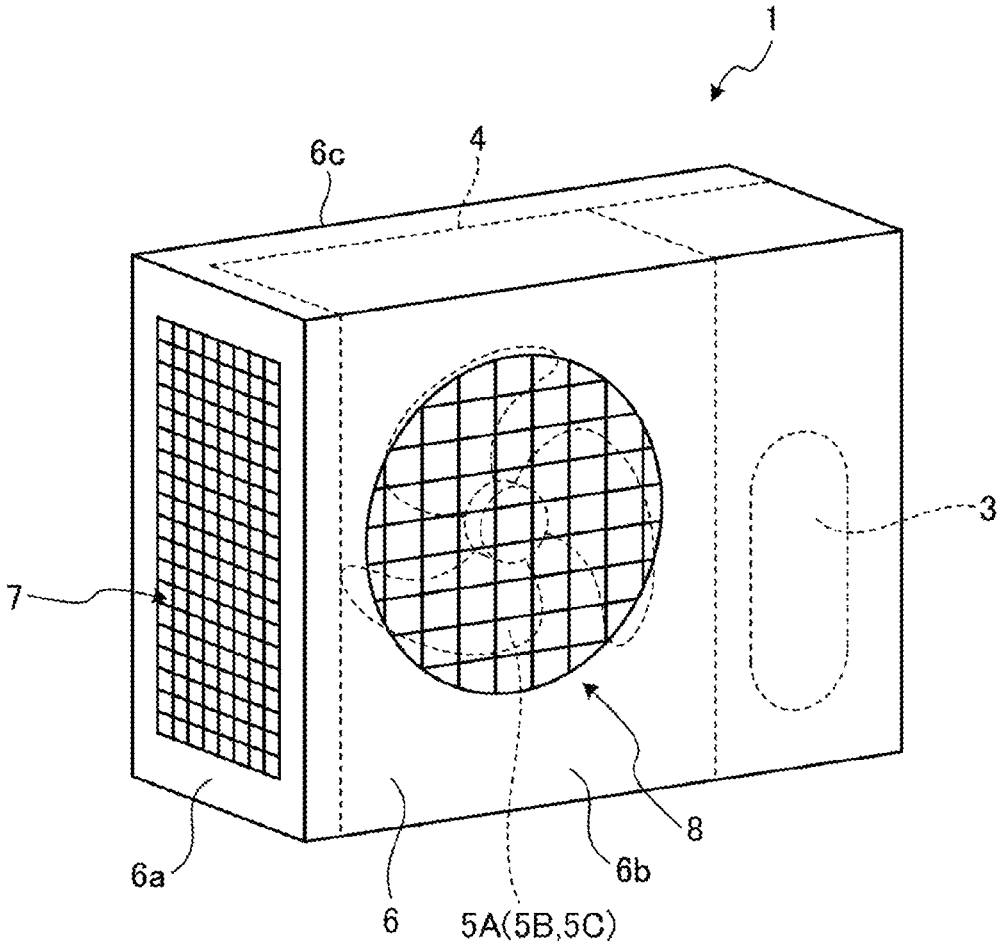
FIG. 1 is a schematic view illustrating an outdoor unit having a propeller fan according to a first example (second and third examples).

FIG. 1 is a schematic view illustrating an outdoor unit having a "propeller fan according to the first example". As illustrated in FIG. 1, an outdoor unit 1 of the first example is an outdoor unit of an air conditioner. The outdoor unit 1 has a housing 6. Inside the housing 6, a "compressor 3 for compressing a refrigerant", a "heat exchanger 4 that is coupled to the compressor 3 and through which the refrigerant flows", and a "propeller fan 5A that blows air to the heat exchanger 4" are housed.

The housing 6 has an "inlet 7 for taking in outside air" and an "outlet 8 for exhausting the air in the housing 6". The inlet 7 is provided on the "side surface 6*a* and the back surface 6*c* of the housing 6". The outlet 8 is provided on the front surface 6*b* of the housing 6. The heat exchanger 4 is arranged over the "back surface 6*c* that faces the front surface 6*b* of the housing 6" and the side surface 6*a*. The propeller fan 5A is arranged so as to face the outlet 8 and is rotationally driven by a fan motor (not illustrated). In the following description, the direction of "the wind exhausted from the outlet 8 by the rotation of the propeller fan 5A" is the positive pressure side, and the opposite side is the negative pressure side.

(Propeller Fan According to the First Example)

Figure 2:
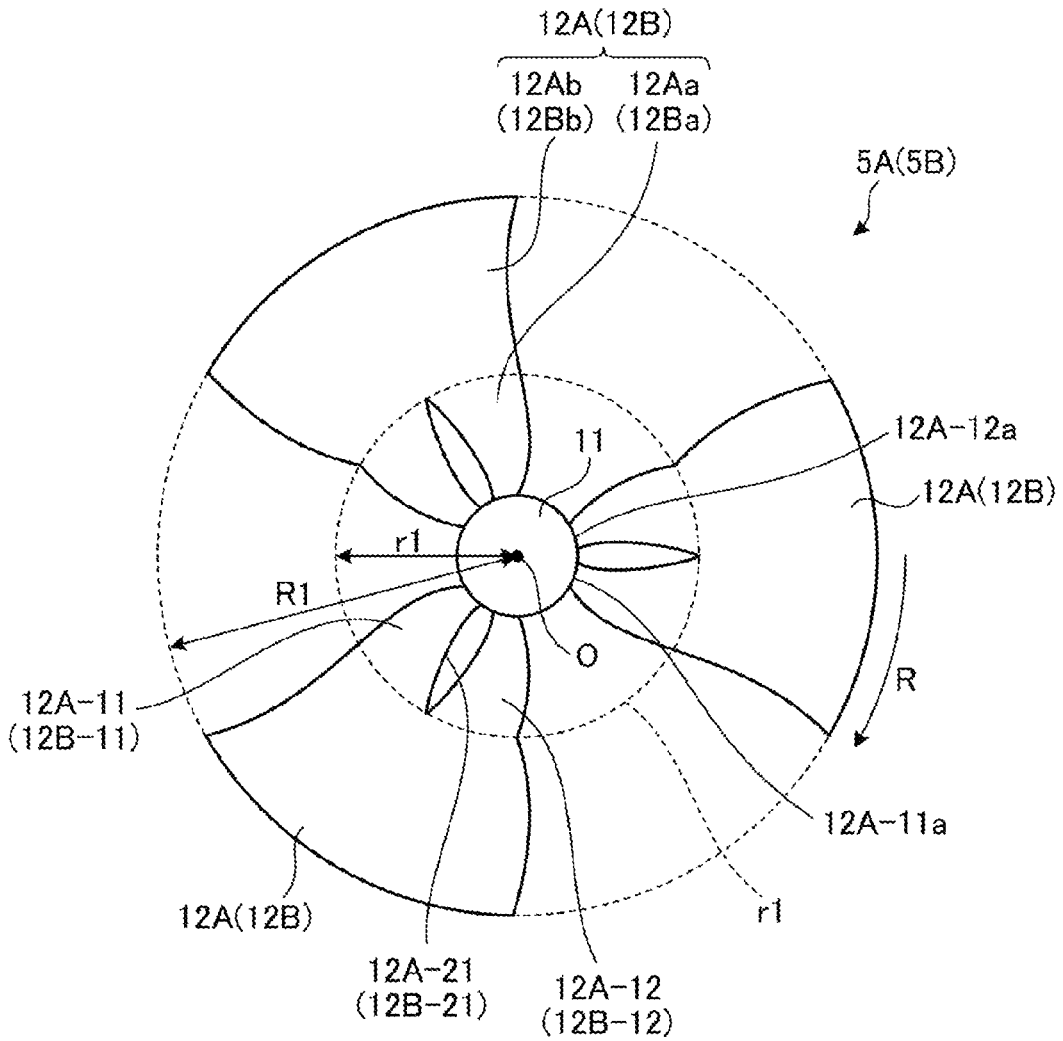
FIG. 2 is a schematic plan view of the fan according to the first example (second example) as viewed from a positive pressure side.

FIG. 2 is a schematic plan view of the propeller fan according to the first example as viewed from the positive pressure side. As illustrated in FIG. 2, the propeller fan 5A according to the first example has a hub 11 having a columnar shape (or a polygonal columnar shape) in appearance and a plurality of blades 12A. The plurality of blades 12A is provided on a "side surface 11*a* provided around the central axis of the hub 11". The hub 11 and the plurality of blades 12A are integrally formed by using "for example, a resin material as a forming material". The blades are also called vanes. The hub 11 is formed in a columnar shape. The hub 11 has a "boss (not illustrated) into which a shaft (not illustrated) of the fan motor is fitted" at a position that is a central axis O. The hub 11 rotates in the "R" direction illustrated in the drawing with the "central axis O of the hub 11 in plan view" as an axis as the fan motor rotates. The boss (not illustrated) is provided on the negative pressure side (see FIG. 3). The plurality of (three in the example of FIG. 2) blades 12A is integrally formed with the hub 11 on the side surface 11*a* of the hub 11 at predetermined intervals along the circumferential direction of the hub 11. The blade 12A is formed in a plate shape.

The propeller fan 5A has an "inner peripheral portion 12Aa and an outer peripheral portion 12Ab of the blade 12A" in plan view illustrated in FIG. 2. The inner peripheral portion 12Aa is located within the circumference of a "circle having the central axis O and a radius r1". The outer peripheral portion 12Ab is located "outside the circumference of the 'circle having the central axis O and the radius r1' and within the circumference of a 'circle having the central axis O and a radius R1'". As illustrated in FIG. 2, as compared with the "inner peripheral portion 12Aa coupled to the hub 11", the "outer peripheral portion 12Ab extended in the radial direction of the hub 11" is formed to have a wider blade area. Here, the ratio r1/R1 between the radius r1 and the radius R1 (hereinafter referred to as "radius ratio") satisfies the following Formula (1).

$$r1/R1 \leq 0.4 \quad (1)$$

For example, the radius ratio r1/R1=0.4 means that "'the boundary between the inner peripheral portion 12Aa and the outer peripheral portion 12Ab of the blade 12A' defined by 'the radius r1 from the central axis O' lies in the "position 0.4 times the length of the radius R1 from the central axis O'". Note that in the present example, r1=88 [mm] (ϕ=176) and radius R1=220 [mm] (ϕ=440) are set as an example.

Further, the propeller fan 5A has blade elements 12A-11 and 12A-12 on the inner peripheral portion 12Aa of each blade 12A in plan view illustrated in FIG. 2. Further, the propeller fan 5A has a hole 12A-21 "between the blade element 12A-11 and the blade element 12A-12 of the inner peripheral portion 12Aa of each blade 12A" in the plan view illustrated in FIG. 2. The hole 12A-21 is provided so as to "contact the boundary between the inner peripheral portion 12Aa and the outer peripheral portion 12Ab (position of the radius r1 from the central axis O)". That is, each blade 12A is connected to the hub 11 such that "'a base 12A-11*a* of the blade element 12A-11 and a base 12A-12*a* of the blade element 12A-12" form the hole 12A-21 in the inner peripheral portion 12Aa". The outer peripheral portion 12Ab is continuous with the blade element 12A-11 and the blade element 12A-12. The inner peripheral portion 12Aa and the outer peripheral portion 12Ab form one blade surface. In the present example, the base 12A-11*a* and the base 12A-12*a* are the base indicated in the claims. That is, the base 12A-11*a* and the base 12A-12*a* are "portions of the blade 12A that are connected to the hub 11".

In other words, the two blade elements 12A-11 and 12A-12 are formed as "the blade 12A is divided on the way from the outer peripheral portion 12Ab of the blade 12A to the inner peripheral portion 12Aa". The hole 12A-21 "between the blade element 12A-11 and the blade element 12A-12" serves as a flow path of the airflow passing through the propeller fan 5A.

Figure 3:
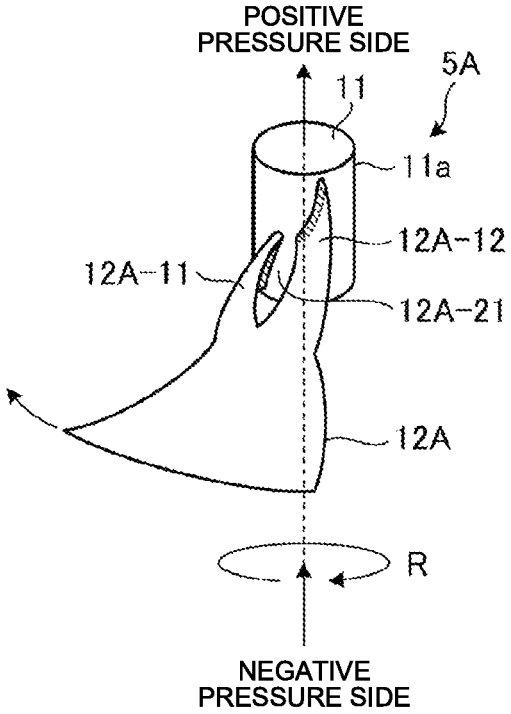
FIG. 3 is a perspective view schematically illustrating the propeller fan according to the first example.

FIG. 3 is a perspective view schematically illustrating the propeller fan according to the first example. FIG. 3 is a schematic enlarged perspective view of "one of 'the plurality of blades 12A illustrated in FIG. 2'". As illustrated in FIG. 3, in the blade 12A, "the blade element 12A-12 located on the upstream side (the trailing edge side) in the rotation direction (the "R" direction in the drawing) is connected to the "positive pressure side as compared with the blade element 12A-11 located on the downstream side (leading edge side)" with respect to the hub 11. Then, the hole 12A-21 of the blade 12A is located "between the blade element 12A-12 and the blade element 12A-11" with respect to the central axis O direction and the circumferential direction.

Then, when the maximum wind speed at the outer peripheral portion 12Ab is V1 [m/s] and the maximum wind speed at the inner peripheral portion 12Aa is V2 [m/s] when the propeller fan 5A rotates, the following Formula (2) is established.

$$V1 \leq V2 \times 2.0 \quad (2)$$

In other words, the wind speed ratio V1/V2, which is "the ratio of the wind speed V1 at the outer peripheral portion 12Ab to the wind speed V2 at the inner peripheral portion 12Aa", satisfies the following Formula (3). Formula (3) is obtained by modifying Formula (2).

$$V1/V2 \leq 2.0 \quad (3)$$

Note that the numbers of "blade elements 12A-11 and 12A-12 and holes 12A-21 of the 'blade 12A of the first example'" are not limited to the numbers illustrated in FIGS. 2 and 3. The blade 12A may have three or more blade elements and two or more holes. That is, the outer peripheral portion 12Ab may be formed (configured) as one blade surface (for example, a blade surface without holes), and the inner peripheral portion 12Aa may include a plurality of blade elements arranged at a predetermined interval.

Second Example (Propeller Fan According to the Second Example)

Figure 4:
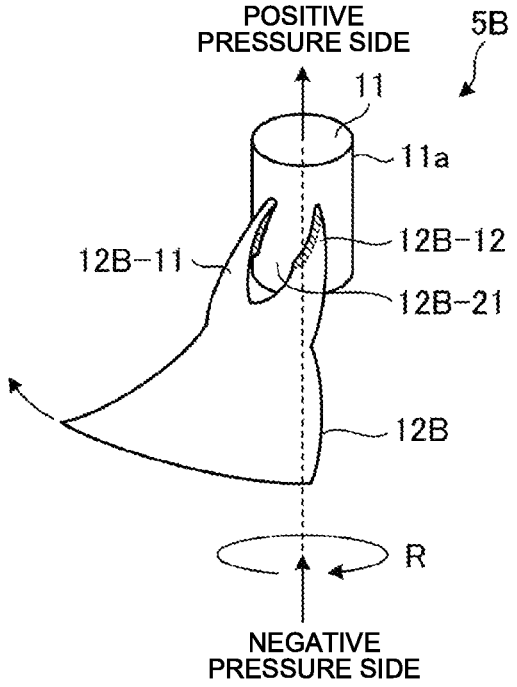
FIG. 4 is a perspective view schematically illustrating the propeller fan according to the second example.

FIG. 4 is a perspective view schematically illustrating the propeller fan according to the second example. Similarly to the propeller fan 5A according to the first example, the propeller fan 5B according to the second example is housed in the outdoor unit 1 illustrated in FIG. 1. Further, the "schematic plan view of the propeller fan 5B viewed from the positive pressure side" is similar to the "similar plan view regarding 'the propeller fan 5A according to the first example illustrated in FIG. 2'". Therefore, in FIG. 2, the reference numerals of the propeller fan 5B and the constituent elements according to the second example are illustrated in parentheses.

FIG. 4 is a schematic enlarged perspective view of "one of the plurality of blades 12B illustrated in FIG. 2". As illustrated in FIG. 4, the blade 12B has "an inner peripheral portion 12Ba, an outer peripheral portion 12Bb, a blade element 12B-11, a blade element 12B-12, a base 12B-11*a*, a base 12B-12*a*, and a hole 12B-21" similar to "the inner peripheral portion 12Aa, the outer peripheral portion 12Ab, the blade element 12A-11, the blade element 12A-12, the base 12A-11*a*, the base 12A-12*a*, and the hole 12A-21" of the blade 12A. However, in the blade 12B, the "blade element 12B-12 located on the upstream side in the rotation direction ("R" direction in the drawing)" and the "blade element 12B-11 located on the downstream side" are connected to "the same height position in the central axis O direction of the hub 11".

Then, also in the blade 12B according to the second example, as in the blade 12A according to the first example, the above Formulae (1) to (3) are established.

Note that the numbers of "blade elements 12B-11 and 12B-12 and holes 12B-21 of the 'blade 12B of the second example'" are not limited to the numbers illustrated in FIGS. 2 and 4. The blade 12B may have three or more blade elements and two or more holes. That is, the outer peripheral portion 12Bb may be formed (configured) as one blade surface (for example, a blade surface without holes), and the inner peripheral portion 12Ba may include a plurality of blade elements arranged at a predetermined interval.

(Relationship Between Air Flow Rate and Static Pressure, and Relationship Between Radius Ratio and Wind Speed Ratio)

Figure 5:
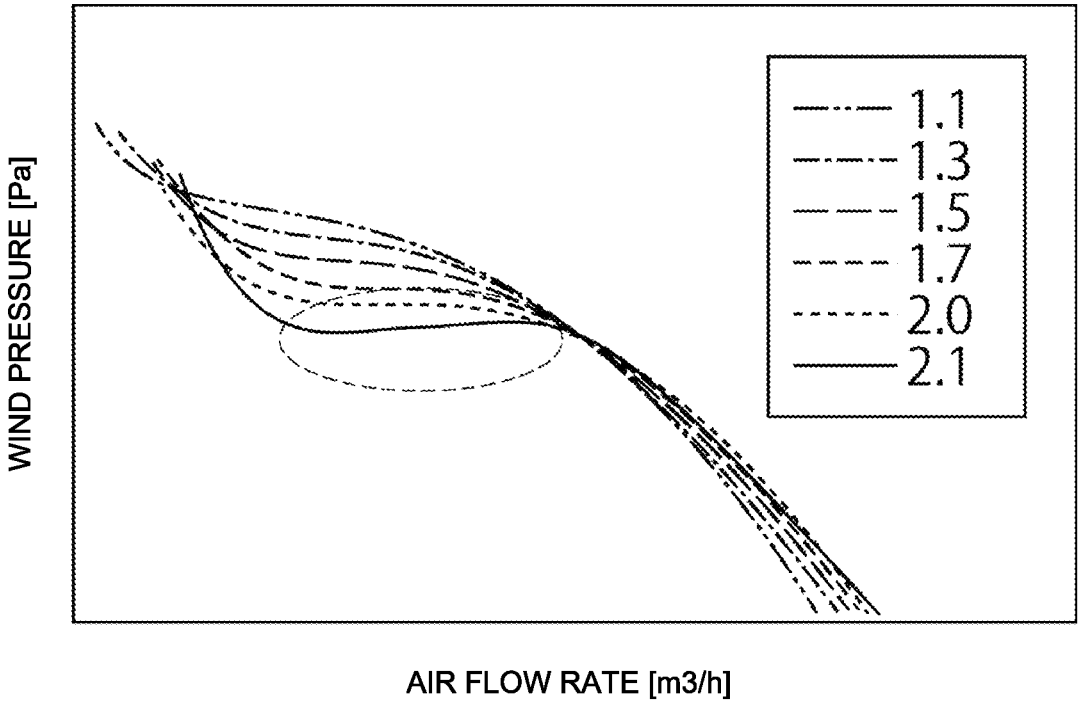
FIG. 5 is a P-Q curve diagram.

FIG. 5 is a P-Q curve diagram. FIG. 5 illustrates "the basis for setting the radius ratio to 0.4 or less and the wind speed ratio V1/V2 to 2.0 or less in the propeller fans of the first example and the second example". In FIG. 5, an air flow rate Q [$m^3$/h] is on the horizontal axis and a wind pressure P [Pa] is on the vertical axis.

Here, FIG. 5 illustrates P-Q curves for "the cases where the wind speed ratio V1/V2 is 1.1, 1.3, 1.5, 1.7, 2.0, and 2.1". FIG. 5 corresponds to "the propeller fan 5A (5B) having the plurality of blade elements 12A-11 and 12A-12 (12B-11 and 12B-12) in the inner peripheral portion 12Aa (12Ba)". In the propeller fan for each data, the chord length (length of a straight line connecting "one end and the other end of the blade element in the longitudinal direction of the cross section") of the blade elements 12A-11 and 12A-12 (12B-11 and 12B-12) is adjusted such that "the wind speed ratio V1/V2 becomes the above numerical value". In the propeller fan with the wind speed ratio V1/V2 of 2.1, the minimum and maximum values of the cubic curve appear in the characteristics of the P-Q curve. This means that the surging phenomenon is occurring (see the portion surrounded by the broken lines in FIG. 5).

Here, the surging phenomenon occurs "when, in the blade 12A, the air blowing capacity of the inner peripheral portion 12Aa is lower than that of the outer peripheral portion 12Ab, and the difference between the wind speed at the inner peripheral portion 12Aa and the wind speed at the outer peripheral portion 12Ab (wind speed difference) becomes large". The surging phenomenon occurs in the flow rate range in which "the minimum value and the maximum value of the cubic curve appear in the P-Q characteristics of the propeller fan". The surging phenomenon is a phenomenon in which "'the pressure and flow rate' of the wind become unstable and largely fluctuate in the above flow rate range". When the propeller fan is operated within the "flow rate range in which this phenomenon occurs", vibration and/or back flow occurs. As a result, normal operation becomes difficult due to occurrence of "abnormal noise and/or pressure pulsation".

On the other hand, in the case of the wind speed ratio V1/V2≤2.0, the smaller the wind speed ratio V1/V2 is, the more smooth the P-Q curve is, the surging phenomenon does not occur, and the air flow rate can be improved.

From the above, it has been found that when the wind speed ratio V1/V2 exceeds 2.0, a surging region occurs depending on the blade shape. On the other hand, it has been found that when the wind speed ratio V1/V2 is 2.0 or less, the occurrence of the surging region can be suppressed regardless of the blade shape.

Note that, regarding the relationship between the air flow rate [$m^3$/h] and the input [W], as compared with "the propeller fan with the wind speed ratio V1/V2 of 2.1", in the case of the "propeller fan with the wind speed ratio V1/V2≤2.0", the "input power for outputting the same air flow rate (power input to a fan motor, which is not illustrated, for driving the propeller fan)" can be small. Also, when the input power is the same, the larger the wind speed ratio V1/V2, the larger the air flow rate. Further, regarding the relationship between the air flow rate [$m^3$/h] and the rotation rate [rpm], as compared with the "propeller fan with the wind speed ratio V1/V2=2.1", in the case of the "propeller fan with the wind speed ratio V1/V2≤2.0", the rotation rate for obtaining the same air flow rate can be small. Also, the larger the wind speed ratio V1/V2, the larger the air flow rate.

From the above, in the first example and the second example, when the propeller fans 5A and 5B satisfy the two conditions: radius ratio r1/R1≤0.4 and V1≤V2×2.0 (or V1/V2≤2.0), the occurrence of surging can be suppressed.

Third Example

Figure 6:
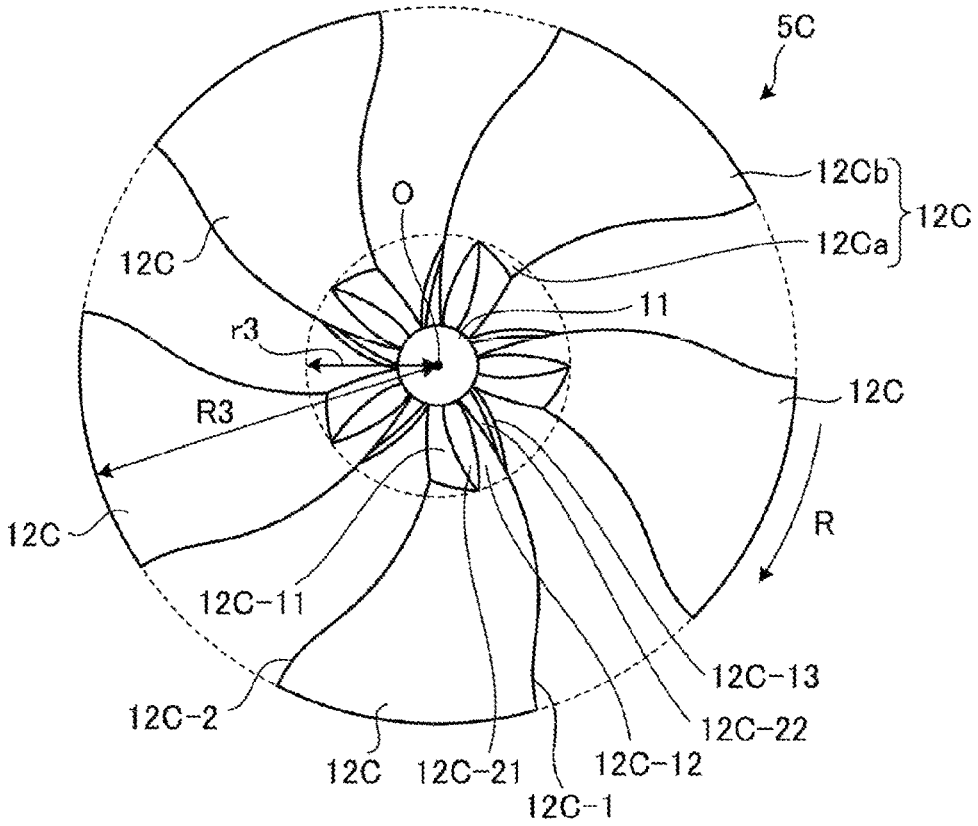
FIG. 6 is a plan view of the propeller fan according to the third example as viewed from a positive pressure side.
Figure 7:
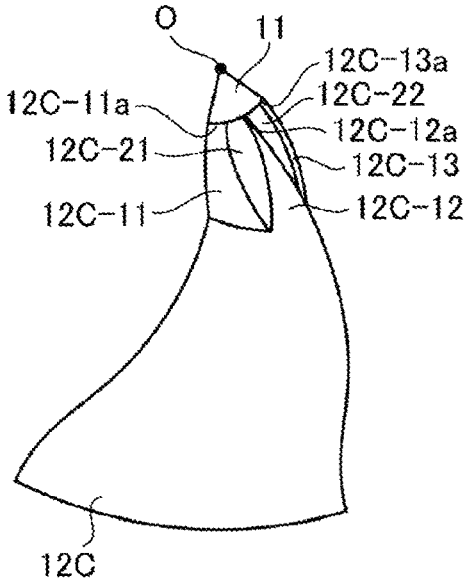
FIG. 7 is a plan view of one of blades of the propeller fan according to the third example as viewed from a positive pressure side.
Figure 8:
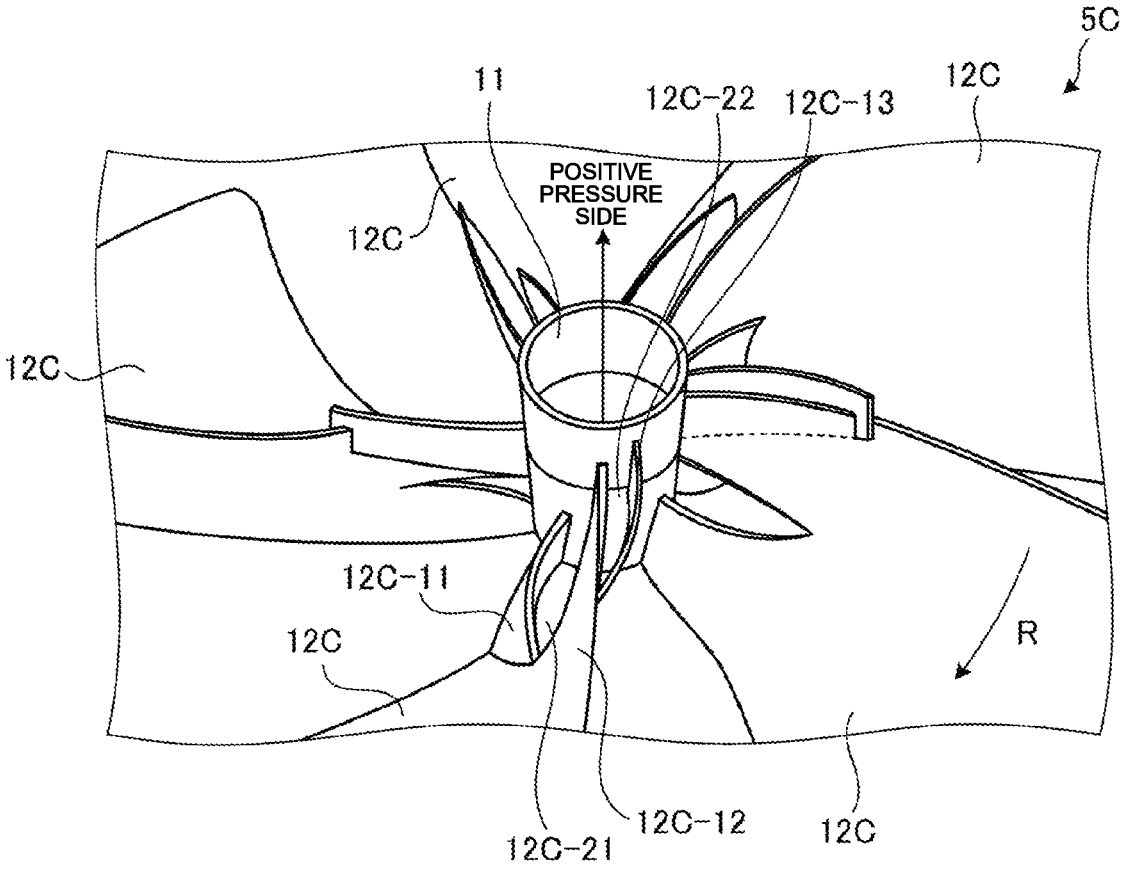
FIG. 8 is a perspective view of a vicinity of a root of a blade of the propeller fan according to the third example as viewed from the positive pressure side.
Figure 9:
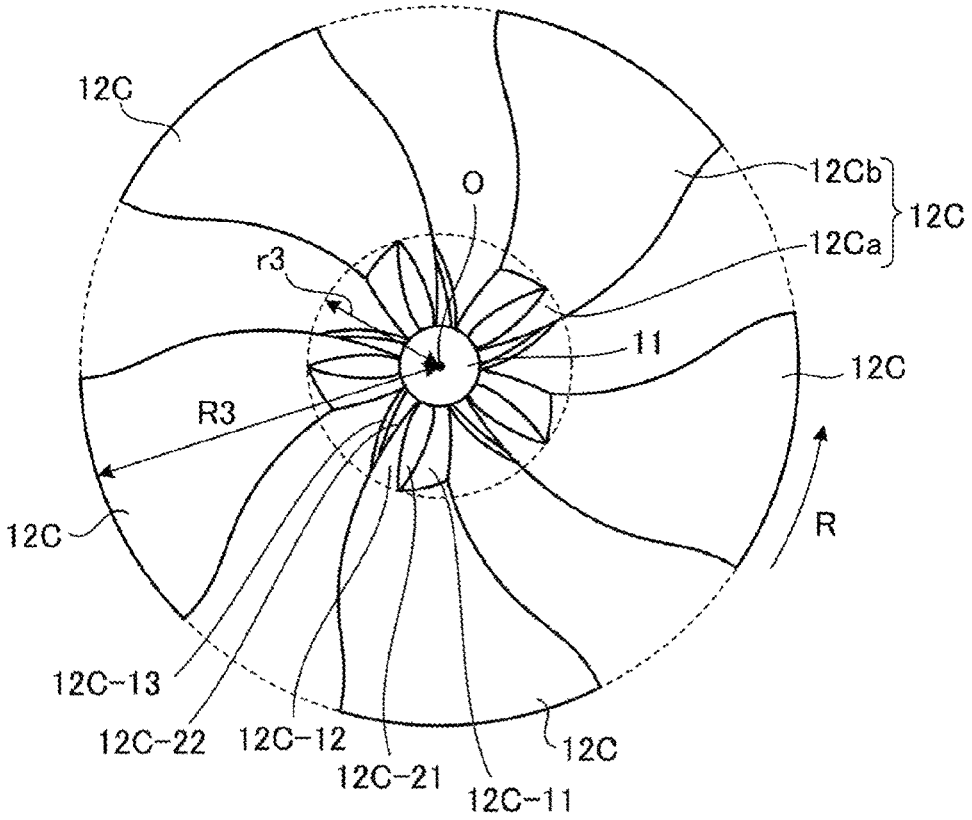
FIG. 9 is a plan view of the propeller fan according to the third example as viewed from a negative pressure side.
Figure 10:
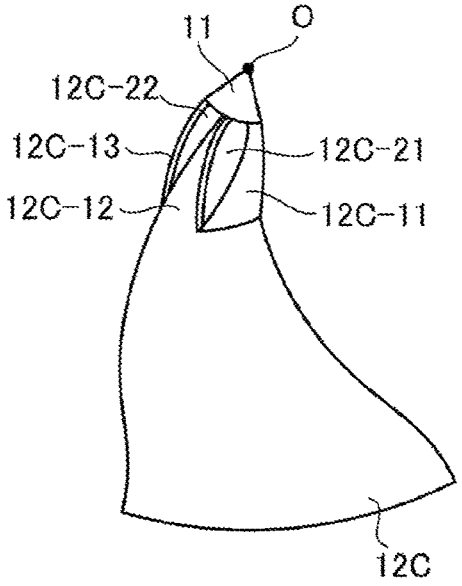
FIG. 10 is a perspective view of one of blades of the propeller fan according to the third example as viewed from the negative pressure side.

FIG. 6 is a plan view of the propeller fan according to the third example as viewed from a positive pressure side. FIG. 7 is a plan view of "one of blades of 'the propeller fan according to the third example'" as viewed from a positive pressure side. FIG. 8 is a perspective view of "a vicinity of a root of a blade of 'the propeller fan according to the third example'" as viewed from the positive pressure side. Further, FIG. 9 is a plan view of the propeller fan according to the third example as viewed from the negative pressure side. FIG. 10 is a perspective view of "one of blades of 'the propeller fan according to the third example'" as viewed from the negative pressure side.

Figure 11:
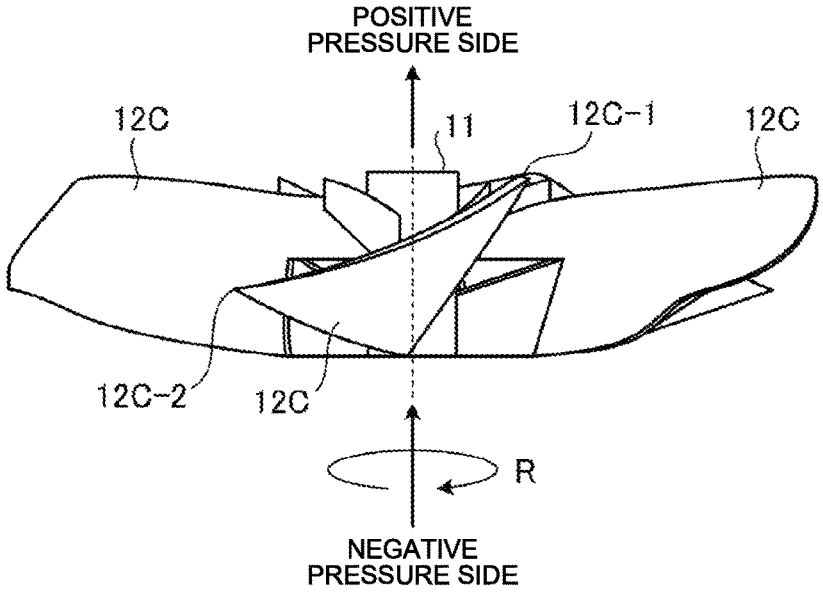
FIG. 11 is a side view illustrating the propeller fan according to the third example.
Figure 12:
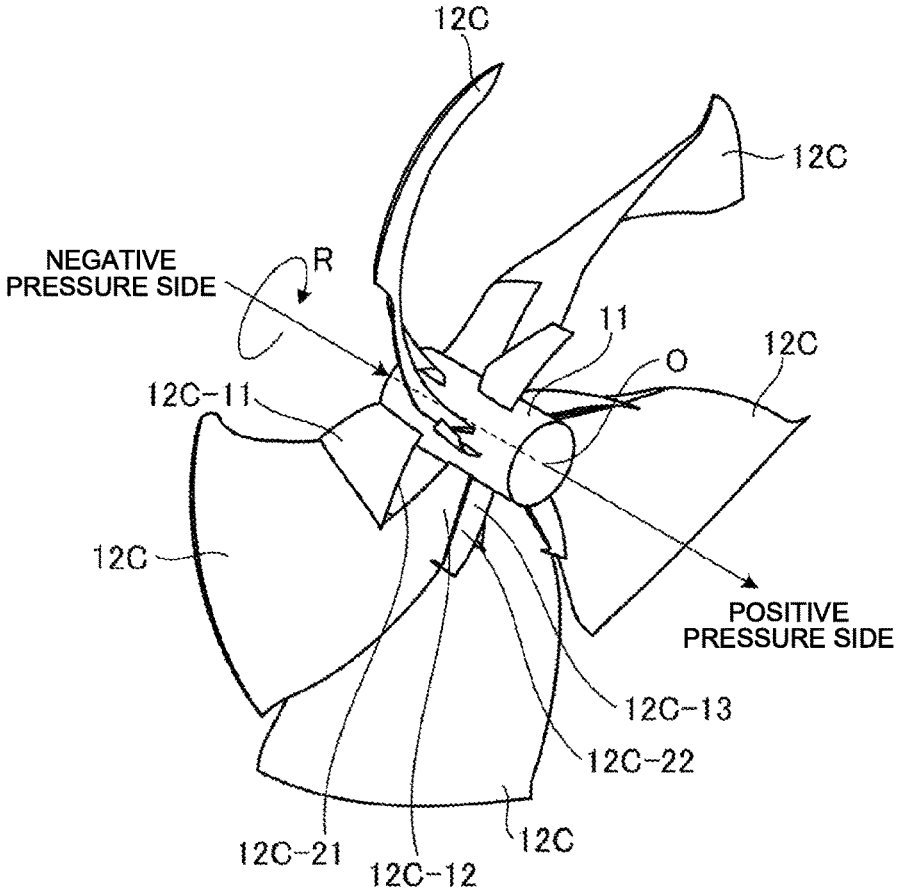
FIG. 12 is a perspective view illustrating the propeller fan according to the third example.
Figure 13:
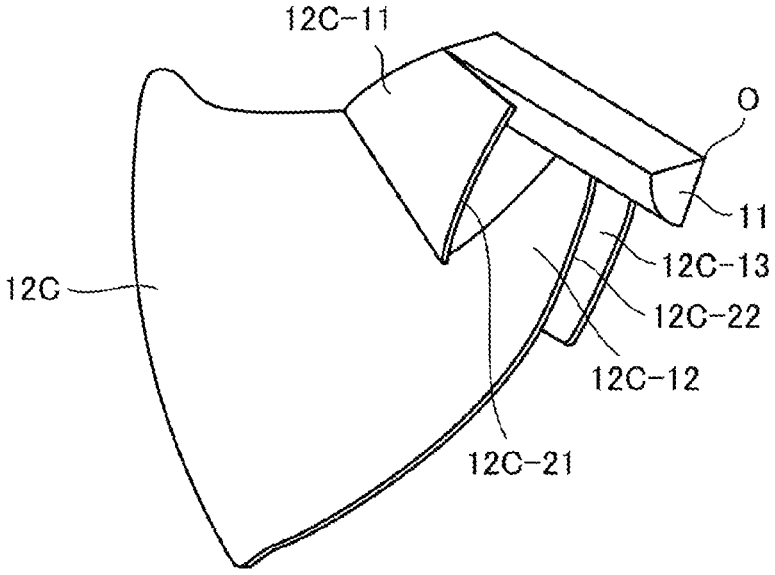
FIG. 13 is a perspective view of one of blades of the propeller fan according to the third example.
Figure 14:
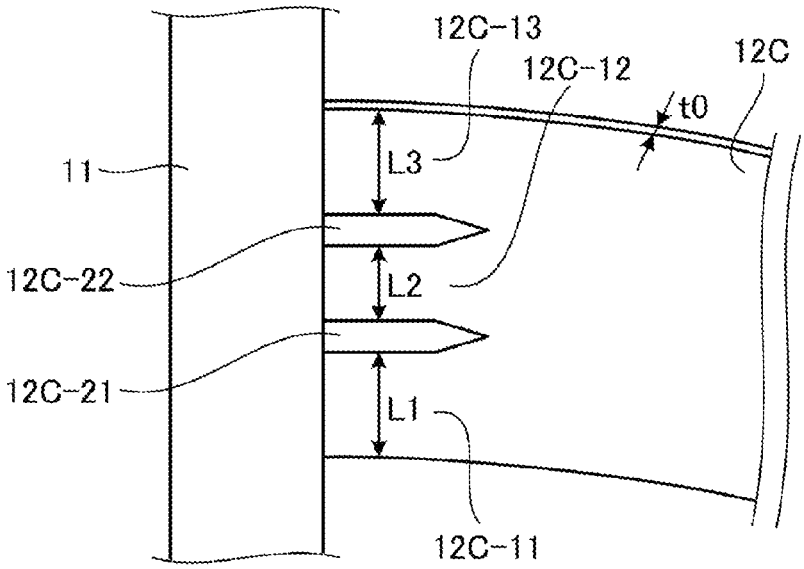
FIG. 14 is a diagram schematically illustrating each chord length and a total chord length of a blade element.

Further, FIG. 11 is a side view illustrating the propeller fan according to the third example. FIG. 12 is a perspective view illustrating the propeller fan according to the third example. FIG. 13 is a perspective view of "one of blades of 'the propeller fan according to the third example'". FIG. 14 is a diagram schematically illustrating "each chord length and a total chord length" of the blade element. Note that similarly to "the propeller fan 5A according to the first example and the propeller fan 5B according to the second example", the propeller fan 5C according to the third example is housed in the outdoor unit 1 illustrated in FIG. 1.

As illustrated in FIGS. 6 to 14, the propeller fan 5C according to the third example has a hub 11 having a columnar shape and "a plurality of blades 12C provided on the side surface of the hub 11". The hub 11 and the plurality of blades 12C are integrally formed by using "for example, a resin material as a forming material". The plurality of (five in the third example) blades 12C is integrally formed with the hub 11 on the side surface 11*a* of the hub 11 at predetermined intervals along the circumferential direction of the hub 11. The blade 12C is formed in a plate shape.

The propeller fan 5C has an "inner peripheral portion 12Ca and an outer peripheral portion 12Cb of the blade 12C" in plan view illustrated in FIG. 6. The inner peripheral portion 12Ca is located within the circumference of a "circle having the central axis O and a radius r3". The outer peripheral portion 12Cb is located "outside the circumference of the 'circle having the central axis O and the radius r3' and within the circumference of a 'circle having a radius R3 of the propeller fan 5C'". As illustrated in FIG. 6, as compared with the "inner peripheral portion 12Ca coupled to the hub 11", the "outer peripheral portion 12Cb extended in the radial direction of the hub 11" is formed to have a wider blade area. In the blade 12C, "the trailing edge portion 12C-1 which is 'the upstream side in the rotation direction of the blade 12C (the direction of the "R" illustrated in FIG. 6)'" is formed to curve toward the "leading edge portion 12C-2 located on the opposite side of the trailing edge portion 12C-1'" (see also FIG. 11). The trailing edge portion 12C-1 is curved as viewed from the rotation axis direction of the central axis O.

Then, the surface (blade surface) of the blade 12C is formed to "gently curve from the trailing edge portion 12C-1 to the leading edge portion 12C-2 from the negative pressure side to the positive pressure side of the propeller fan 5C in the circumferential direction of the hub 11" (see, for example, FIG. 9). By rotating the "propeller fan 5C having such blades 12C" in the R direction (the "R" direction illustrated in FIG. 6), air flows from the negative pressure side to the positive pressure side. As the rotation rate of the propeller fan 5C increases, the amount of the "air flowing from the negative pressure side to the positive pressure side" increases.

Here, the ratio r3/R3 (radius ratio) of the radius r3 and the radius R3 satisfies the following Formula (4).

$$r3/R3 \leq 0.7 \quad (4)$$

For example, the radius ratio r3/R3=0.7 means that "'the boundary between the inner peripheral portion 12Ca and the outer peripheral portion 12Cb of the blade 12C' defined by 'the radius r3 from the central axis O' lies in the "position 0.7 times the length of the radius R3 from the central axis O'".

Further, as illustrated in FIGS. 8 to 14, the propeller fan 5C has three blade elements 12C-11, 12C-12, and 12C-13 on the inner peripheral portion 12Ca of each blade 12C. Further, the propeller fan 5C has, for example, as illustrated in detail in FIG. 8, a hole 12C-21 "between the blade element 12C-11 and the blade element 12C-12 of the inner peripheral portion 12Ca of each blade 12C". Further, the propeller fan 5C has a hole 12C-22 "between the blade element 12C-12 and the blade element 12C-13 of the inner peripheral portion 12Ca of each blade 12C". That is, each blade 12C is connected to the hub 11 such that "'a base 12C-11*a* of the blade element 12C-11, a base 12C-12*a* of the blade element 12C-12, and a base 12C-13*a* of the blade element 12C-13" form the holes 12C-21 and 12C-22 in the inner peripheral portion 12Ca". The outer peripheral portion 12Cb is continuous with "the blade elements 12C-11, 12C-12, and 12C-13". The inner peripheral portion 12Ca and the outer peripheral portion 12Cb form one blade surface. In the present example, "the base 12C-11*a*, the base 12C-12*a*, and the base 12C-13*a*" are the base indicated in the claims. That is, "the base 12C-11*a*, the base 12C-12*a*, and the base 12C-13*a*" are "portions of the blade 12C that are connected to the hub 11".

In other words, the three blade elements 12C-11, 12C-12, and 12C-13 are formed as "the blade 12C is divided on the way from the outer peripheral portion 12Cb of the blade 12C to the inner peripheral portion 12Ca". "The hole 12C-21 between 'the blade element 12C-11 and the blade element 12C-12' and the hole 12C-22 between 'the blade element 12C-12 and the blade element 12C-13'" serve as flow paths for the airflow passing through the propeller fan 5C.

For example, as illustrated in FIGS. 7 and 8, in one blade 12C, the base 12C-13*a* of "the blade element 12C-13 located on the most upstream side (trailing edge side) in the rotation direction (the "R" direction in the drawing)" is, as compared with "'the base 12C-12*a* of the blade element 12C-12' and 'the base 12C-11*a* of the blade element 12C-11' located on the downstream side (leading edge side)", connected to the "positive pressure side relative to the central axis O direction" with respect to the hub 11. Further, "the base 12C-12*a* of the blade element 12C-12" is connected to the "positive pressure side relative to the central axis O direction" of the hub 11 as compared with "the base 12C-11*a* of the blade element 12C-11". Then, the hole 12C-21 of the blade 12C is located "between the blade element 12C-12 and the blade element 12C-11" with respect to the central axis O direction and the circumferential direction. The hole 12C-22 of the blade 12C is located "between the blade element 12C-13 and the blade element 12C-12" with respect to the central axis O direction and the circumferential direction.

Then, when the total chord length, which is the sum of the "chord lengths of the blade elements 12C-11 to 12C-13 of the inner peripheral portion 12Ca," is set to L0 [mm], and "the minimum chord length of each chord length of the blade elements 12C-11 to 12C-13 (the length of the straight line connecting 'one end and the other end of the blade element in the longitudinal direction of the cross section') is set to Lmin [mm], the following Formula (5) is established.

$$L\ \mathrm{min}/L0 \geq 0.1 \quad (5)$$

For example, as illustrated in FIG. 14, the respective chord lengths of the blade elements 12C-11 to 12C-13 are L1 [mm], L2 [mm], and L3 [mm], and the size relation of L1<L2<L3 is established. At this time, Lmin is L1 and L0 is L1+L2+L3, and from the above Formula (5), L1/(L1+L2+L3)≥0.1 is established.

Further, FIGS. 6 to 14 illustrate an aspect in which "the holes 12C-21 and 12C-22 extend to the hub 11". However, when the above Formulae (4) to (5) are satisfied, the "shape, aspect, or the like of the holes 12C-21 and 12C-22" can be appropriately changed. For example, an aspect is also possible in which "the holes 12C-21 and 12C-22 reach the positions separated from the hub 11 by a predetermined distance".

As will be described later, in the third example, when the propeller fan 5C satisfies "the conditions of the radius ratio r3/R3≤0.7 and Lmin/L0≥0.1", surging is less likely to occur, and the air flow rate can be improved.

Note that the numbers of the "blade elements 12C-11 to 12C-13 and holes 12C-21 and 12C-22 of the 'blade 12C of the third example'" are not limited to the numbers illustrated in FIGS. 8 to 13. The blade 12C may have two blade elements and one hole. Alternatively, the blade 12C may have four or more blade elements and three or more holes. That is, the outer peripheral portion 12Cb may be formed of one blade surface, and the inner peripheral portion 12Ca may include "at least one hole" and "a plurality of blade elements formed across the hole".

Further, the holes 12C-21 and 12C-22 may be formed in a range "from the boundary between the inner peripheral portion 12Ca and the outer peripheral portion 12Cb to the side surface of the hub 11 in the radial direction". Further, the holes 12C-21 and 12C-22 may be formed so as to "contact both the above-mentioned boundary and the side surface of the hub 11".

(Relationship Between Radius Ratio and Air Flow Rate Air and Efficiency, and Relationship Between Minimum Chord Length of Blade Element/Total Chord Length of Blade Element and Air Flow Rate and Efficiency)

Figure 15:
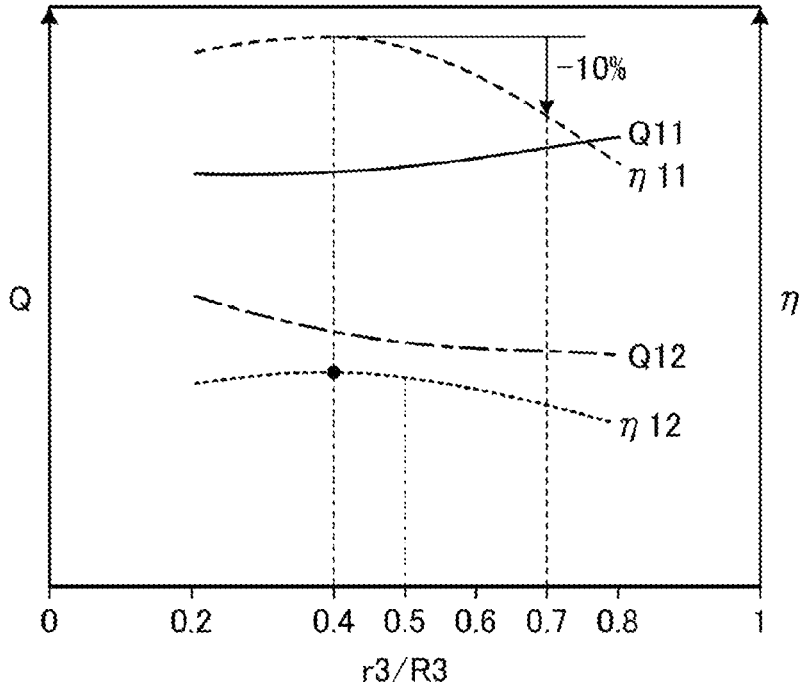
FIG. 15 is a curve diagram illustrating the relationship between radius ratio and air flow rate and efficiency.
Figure 16:
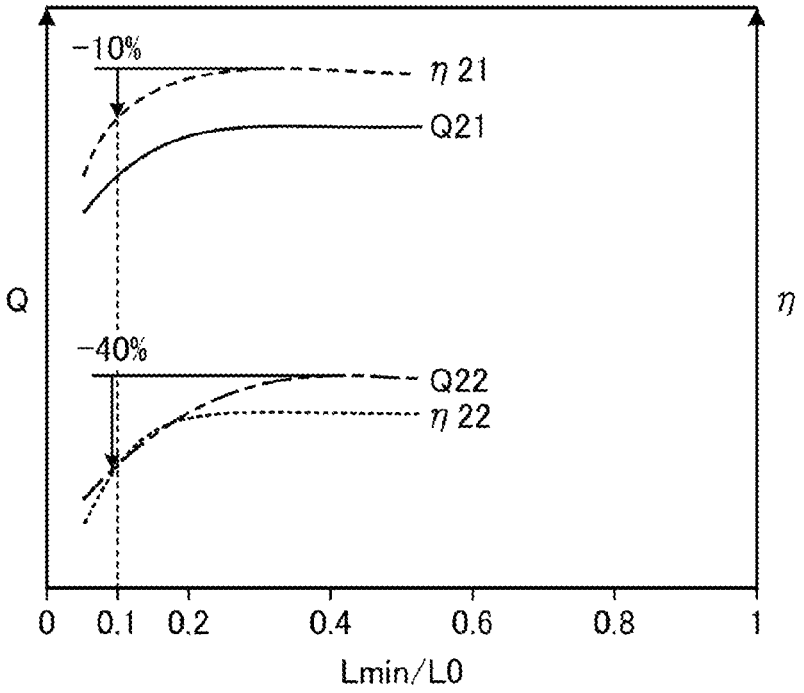
FIG. 16 is a curve diagram illustrating the relationship between a minimum chord length of a blade element/a total chord length of a blade element and air flow rate and the efficiency.

FIG. 15 is a graph (curve diagram) illustrating the relationship between radius ratio and "air flow rate and efficiency". FIG. 16 is a graph (curve diagram) illustrating the relationship between "'minimum chord length of blade element/total chord length of blade element'" and "air flow rate and the efficiency". FIG. 15 illustrates the reason why the radius ratio is 0.7 or less in the third example. Further, FIG. 16 illustrates the reason why the minimum chord length of the blade element/the total chord length of the blade element is 0.1 or more in the third example.

In FIG. 15, the radius ratio is on the horizontal axis, and air flow rate Q [$m^3$/h] and efficiency η (=air flow rate Q/input) [$m^3$/h/W] is on the vertical axis. In FIG. 15, air flow rate Q11 and efficiency η11 correspond to "the air flow rate and the efficiency when 'the propeller fan 5C rotates at a rated load of the air conditioner'". On the other hand, air flow rate Q12 and efficiency η12 correspond to "the air flow rate and the efficiency when 'the propeller fan 5C rotates at a load higher than the rated load of the air conditioner'". It is preferable that the efficiencies η11 and η12 do not drop extremely below the peak value at both the rated load and the high load.

In FIG. 15, in the case of the radius ratio of r3/R3≤0.4 to 0.5, the efficiencies η11 and η12 illustrate peak values. Therefore, at the rated load, in the case of the radius ratio of r3/R3≤0.7, the efficiency ill of the propeller fan 5C falls within the range "from the peak value to about −10% or less of the peak value". Further, in the case of the radius ratio of r3/R3≤0.5 under a high load, the "air flow rate Q12 and efficiency η12" of the propeller fan 5C became the highest.

Further, in FIG. 16, "minimum chord length of base of blade element/total chord length of blade element (=Lmin/L0)" is on the horizontal axis, and air flow rate Q [$m^3$/h] and efficiency η [$m^3$/h/W] is on the vertical axis. In FIG. 16, air flow rate Q21 and efficiency η21 correspond to "the air flow rate and the efficiency when 'the propeller fan 5C rotates at a rated load of the air conditioner'". On the other hand, air flow rate Q22 and efficiency η22 correspond to "the air flow rate and the efficiency when 'the propeller fan 5C rotates at a load higher than the rated load of the air conditioner'".

As illustrated in FIG. 16, regarding the efficiency η21 at the rated load, the amount of reduction in efficiency η21 at the rated load in the "total region of the minimum chord length of blade element/total chord length of blade element (=Lmin/L0)" is as small as "10% of the peak value". Therefore, there is no particular limitation on the "minimum chord length of blade element/total chord length of blade element (=Lmin/L0)". On the other hand, in FIG. 16, at the high load, in the case of "minimum chord length of blade element/total chord length of blade element (=Lmin/L0) <0.1", the reduction rate of air flow rate Q21 is 40% or more of the peak value. From this reason, the minimum chord length of the blade element/total chord length of the blade element (=Lmin/L0)≥0.1.

Therefore, according to the above-mentioned first to third examples, "the wind speed at the inner peripheral portions 12Aa, 12Ba, and 12Ca" can be improved without depending on the improvement of "the wind speed at 'the respective outer peripheral portions 12Ab, 12Bb, and 12Cb of the blades 12A, 12B, and 12C'". Therefore, it is possible to suppress the difference (wind speed difference) between the wind speed at the "outer peripheral portions 12Ab, 12Bb, and 12Cb" and the wind speed at the "inner peripheral portions 12Aa, 12Ba, and 12Ca". Thus, it is possible to suppress "an abnormal operating state such as airflow turbulence at the inner peripheral portions 12Aa to 12Ca and a surging phenomenon caused by airflow stall" caused by the wind speed difference. As a result, it is possible to increase the "air flow rate that can be generated by the rotation of the propeller fans 5A, 5B, and 5C".

The embodiments have been described above. However, the technology disclosed in the present application is not limited to the above content. Further, the above-described constituent elements include "those that can be easily assumed by those skilled in the art, substantially the same, and so-called equivalent ranges". Furthermore, the constituent elements described above can be combined as appropriate. Furthermore, at least one of "various omissions, replacements, and changes of constituent elements" can be performed without departing from the spirit of the embodiments.

Note that the radius ratio r1/R1=0.4 may mean that, in the blade 12A, on the assumption that the radius R1 from the central axis O is 1 with respect to the boundary between the inner peripheral portion 12Aa and the outer peripheral portion 12Ab, the radius r1 from the central axis O lies in the position 0.4 times the length of the radius R1. The radius ratio r3/R3=0.7 may mean that, in the blade 12C, on the assumption that the radius R3 from the central axis O is 1 with respect to the boundary between the inner peripheral portion 12Ca and the outer peripheral portion 12Cb, the radius r3 from the central axis O lies in the position 0.7 times the length of the radius R3.

REFERENCE SIGNS LIST

1 OUTDOOR UNIT
3 COMPRESSOR

4 HEAT EXCHANGER
5A, 5B, 5C PROPELLER FAN
6 HOUSING
6*a* SIDE SURFACE
6*b* FRONT SURFACE
6*c* BACK SURFACE
7 INLET
8 OUTLET
11 HUB
12A, 12B, 12C BLADE
12Aa, 12Ba, 12Ca INNER PERIPHERAL PORTION
12Ab, 12Bb, 12Cb OUTER PERIPHERAL PORTION
12A-21, 12B-21, 12C-21, 12C-22 HOLE
12C-1 TRAILING EDGE PORTION
12C-2 LEADING EDGE PORTION
12A-11, 12A-12, 12B-11, 12B-12, 12C-11, 12C-12, 12C-13 BLADE ELEMENT

The invention claimed is:

1. A propeller fan comprising:

a hub that has a side surface around a central axis; and a plurality of blades that are provided on the side surface of the hub, wherein a blade of the plurality of blades includes an inner peripheral portion that is located on a side of a base connected to the hub of the blade, and an outer peripheral portion that is located on a side of an outer edge of the blade, the outer peripheral portion is formed as one blade surface, the inner peripheral portion includes a plurality of blade elements arranged at a predetermined interval, a ratio r/R in which a radius r which is a distance from the central axis to a boundary between the inner peripheral portion and the outer peripheral portion and a radius R which is a distance from the central axis to the outer edge of the blade is 0.4 or less, and wherein the outer peripheral portion increases in width as the outer peripheral portion extends towards the outer edge of the blade, and wherein the propeller fan is configured such that, in operation, when a wind speed at the outer peripheral portion is V1 and a wind speed at the inner peripheral portion is V2, each chord length of the plurality of blades is configured such that a relational formula of V1≤V2×2.0 is satisfied.

2. A propeller fan comprising:

a hub that has a side surface around a central axis; and a plurality of blades that are provided on the side surface of the hub, wherein a blade of the plurality of blades includes an inner peripheral portion that is located on a side of a base connected to the hub of the blade, and an outer peripheral portion that is located on a side of an outer edge of the blade, the outer peripheral portion is formed as one blade surface, the inner peripheral portion includes a plurality of blade elements arranged at a predetermined interval, a ratio r/R in which a radius r which is a distance from the central axis to a boundary between the inner peripheral portion and the outer peripheral portion and a radius R which is a distance from the central axis to the outer edge of the blade is 0.4 or less, and wherein the plurality of blade elements include a first blade element and a second blade element, the first blade element and the second blade element are respectively positioned on a downstream side and an upstream side in a rotation direction with respect to the hub, and a first height on a most positive pressure side in the center axis direction, in a portion connecting the first blade element and the side surface of the hub is positioned between a second height on a most negative pressure side in the center axis direction, in a portion connecting the second blade element and the side surface of the hub, and a third height on a most positive pressure side in the center axis direction, in the portion connecting the second blade element and the side surface of the hub, and wherein the propeller fan is configured such that, in operation, when a wind speed at the outer peripheral portion is V1 and a wind speed at the inner peripheral portion is V2, each chord length of the plurality of blades is configured such that a relational formula of V1≤V2×2.0 is satisfied.

3. A propeller fan comprising:

a hub that has a side surface around a central axis; and a plurality of blades that are provided on the side surface of the hub, wherein a blade of the plurality of blades includes an inner peripheral portion that is located on a side of a base connected to the hub of the blade, and an outer peripheral portion that is located on a side of an outer edge of the blade, the outer peripheral portion is formed as one blade surface, the inner peripheral portion includes a plurality of blade elements arranged at a predetermined interval, a ratio r/R in which a radius r which is a distance from the central axis to a boundary between the inner peripheral portion and the outer peripheral portion and a radius R which is a distance from the central axis to the outer edge of the blade is 0.4 or less, and wherein a relational expression of Lmin/L0≥0.1 is satisfied, where a total chord length of the plurality of blade elements is LO, and a minimum one of the chord lengths of the plurality of blade elements is Lmin, and wherein the outer peripheral portion increases in width as the outer peripheral portion extends towards the outer edge of the blade, and wherein the propeller fan is configured such that, in operation, when a wind speed at the outer peripheral portion is VI and a wind speed at the inner peripheral portion is V2, each chord length of the plurality of blades is configured such that a relational formula of V1≤V2×2.0 is satisfied.

* * * * *